US006296676B1

(12) United States Patent
Nohara

(10) Patent No.: US 6,296,676 B1
(45) Date of Patent: Oct. 2, 2001

(54) WATER/OIL EMULSION FUEL

(75) Inventor: Hirotsugu Nohara, 6-10, Kisaichi 8-chome, Katano-shi, Osaka 576-0033 (JP)

(73) Assignees: Hirotsugu Nohara, Katano; Yasushi Saitou, Ashiya; Itsuko Nakajima, Hirakata; Gouichi Nohara, Katano, all of (JP)

( * ) Notice: Subject to any disclaimer, the term of this patent is extended or adjusted under 35 U.S.C. 154(b) by 0 days.

(21) Appl. No.: 09/486,781

(22) PCT Filed: Sep. 3, 1998

(86) PCT No.: PCT/JP98/03951

§ 371 Date: May 19, 2000

§ 102(e) Date: May 19, 2000

(87) PCT Pub. No.: WO99/11741

PCT Pub. Date: Nov. 3, 1999

(30) Foreign Application Priority Data

Sep. 3, 1997 (JP) ..... 9-256068

(51) Int. Cl.[7] ..... C10L 1/12; C10L 1/32
(52) U.S. Cl. ..... 44/301; 44/457
(58) Field of Search ..... 44/301, 457

(56) References Cited

U.S. PATENT DOCUMENTS 3,540,866 * 11/1970 Miller ..... 44/301
5,480,583 1/1996 Rivas et al. .
5,556,574 9/1996 Rivas et al. .
5,603,864 2/1997 Silva et al. .
5,662,920 9/1997 Santus .

FOREIGN PATENT DOCUMENTS 57-55995 4/1982 (JP) .
2-3085 1/1990 (JP) .
2-287005 11/1990 (JP) .
7-3277 1/1995 (JP) .
7-126669 5/1995 (JP) .
8-225744 3/1996 (JP) .

OTHER PUBLICATIONS

Hiroyuki Ihara, "About Emulsion Fuel", Journal of M.E.S.J., vol. 15, No. 7, pp. 483–488 (1980), with English translation.

S. Aramaki, H. Yamamoto and Ohkuri, "Promotion of Combustion Efficiency of Heavy Oil by Addition of Water", Mitsubishi Jukogyo Gihou, vol. 8, No. 4, pp. 67–76 (1971), with English Abstract.

H. Miyano, H. Suzuki, Y. Nagae and J. Hara, "Developments of Stratified Fuel–Water Injection System for Reducing NOx", Mitsubishi Jukogyo Gihou,vol. 32, No. 2, pp. 120–123 (1971), with English abstract.

Osaka Prefecture, "For Prevention of Emission of Nitrogen Oxides—Mainly Combustion Control", Osaka Prefecture Environment and Health Development, Environment Division, Atmosphere Section pp. 22–23 (Nov. 1988), with partial English translation.

* cited by examiner

*Primary Examiner*—Margaret Medley
*Assistant Examiner*—Cephia D. Toomer
(74) *Attorney, Agent, or Firm*—Burns, Doane, Swecker & Mathis, LLP

(57) ABSTRACT

A water-in-oil-type oil-water emulsion fuel which is obtained by mixing heavy oil and water together with sn inorganic component, wherein said inorganic component consists of four kinds of substance of sodium, magnesium, calcium and chlorine, which is characterized in that once the emulsion is obtained, oil-water separation does not occur and the emulsion state is maintained even if any temperature is added in the combustion, and a stable state of the combustion is always attained.

7 Claims, No Drawings

WATER/OIL EMULSION FUEL

TECHNICAL FIELD

The present invention relates to an oil-water emulsion fuel. Particularly, the present invention relates to a water-in-oil emulsion fuel which decreases the discharge of pollutive substances.

BACKGROUND ART

On the combustion of heavy oil, the mass of discharge of air pollutive substances (such as nitrogen oxides, sulfur oxides, carbon dioxide, dust, smog etc.) cannot be avoided, so the research and development of combustion technology preventing the production of such substances has been conducted for a long time. It is indispensable in order to burn heavy oil having high viscosity effectively that heavy oil is heated before the spray at burner and is brought to lower viscosity so that the oil is possible to be sprayed as small particle, and that its evaporation speed and followed mixing with air (oxygen) is accelerated for the diffusion combustion. But nevertheless, it has not brought the problem to solution and the development on technology for the burner and the treatment of combustion gas etc. is still being continued. But there is big burden on the site of the users because of facility cost, installation area, maintenance of plant etc. and therefore efficient combustion based on simplified technology has been required.

One of combustion technologies which was developed in consideration of above problems is an oil-water emulsion fuel in which oil is mixed with water. This oil-water emulsion fuel has an improved combustion efficiency because water particles micro-explode due to the discrepancy of the boiling points between heavy oil and water (b.p. of heavy oil is 300° C. or more, b.p. of water is 100° C.) so that the explosion divides the oil into finer particles and it leads to promotion of diffusion combustion when the emulsion fuel is sprayed into combustion chamber having high temperature. And with this fuel, the production of nitrogen oxides can be decreased owing to the combustion at high temperature. These are the main object for which oil-water emulsion fuel has been developed. The oil-water emulsion fuel is prepared by two processes for production roughly classified, one of which is the method where only oil and water are mechanically mixed and the other one of which is the method where oil and water are mixed with chemical additives (organics).

While the conventional oil-water emulsion fuels have attained the effect that they decrease the production of some of air pollutive substances (nitrogen oxides) by a few ppm, they have not attained good result in combustion efficiency. They still have the problem as follows:

1) In the heating process for lowering the viscosity of heavy oil having high viscosity, the cohesion happens among water particles and the oil and water separate. Therefore, the spraying with maintaining constant particle size of water, which is a essential factor for ideal micro-explosion, cannot be conducted at all.

2) The measurement of viscosity and total calorific power and analysis of components from the change of temperature are difficult as the oil-water separation happens by heating.

3) There is a problem in maintenance that fuel pipes and burners etc. are oxidized by water during the combustion.

4) The concentration of nitrogen oxides and smoke increase more in the combustion at lower oxygen atmosphere than in the combustion of heavy oil only and the condition of the combustion apparently becomes worse. There is a possibility of the production of new pollutive substances in the case of using chemical additives because they are mainly consist of organic components.

5) The transparency of the inside of combustion chamber is very bad and the flame grows thin and long and the state where the oil particles are running can be observed by eyes. This means the combustion is too far from good condition.

6) When the combustion chamber and flue etc. is checked after combustion, it is observed that the thick deposit of impurities is observed on the inside of them and the quantity is high.

DISCLOSURE OF THE INVENTION

According to one aspect, the present invention relates to a water-in-oil, oil-water emulsion fuel which is obtained by mixing heavy oil and water together with an inorganic component. The inorganic component comprises sodium, magnesium, calcium and chlorine. Once the emulsion is obtained, oil-water separation does not occur and the emulsion state is maintained even if any temperature is added during combustion. A stable state of the combustion is always attained.

According to another aspect, the present invention relates to the oil-water emulsion fuel, wherein the amount of the inorganic component is adjusted with respect to the total amounts of water and heavy oil.

According to another aspect, the present invention relates to the oil-water emulsion fuel, wherein the inorganic component is soluble in water.

According to another aspect, the present invention relates to the oil-water emulsion fuel , wherein 485–608 g of sodium, 17–21 g of magnesium, 23–29 9 of calcium and 313–392 g of chlorine are added to the mixture of the water and the heavy oil when 500–1,000 liters of water are mixed with 10,000 liters of heavy oil.

According to another aspect, the present invention relates to the oil-water emulsion fuel, wherein 675–948 g of sodium, 23–34 g of magnesium, 32–45 g of calcium and 436–612 g of chlorine are added to the mixture of the water and the heavy oil when 1,500–2,000 liters of water are mixed with 10,000 liters of heavy oil.

According to a further aspect, the present invention relates to the oil-water emulsion fuel, wherein 1,222–1,710 g of sodium, 42–59 g of magnesium, 59–82 9 of calcium and 790–1,106 g of chlorine are added to the mixture of the water and the heavy oil when 2,500–3,000 liters of water are mixed with 10,000 liters of heavy oil.

In the above described preferred embodiments, the amounts of sodium, magnesium, calcium and chlorine pertain to the amounts of the elements themselves.

BEST MODE FOR CARRYING OUT THE INVENTION

Oil-water emulsion fuel according to the present invention is the fuel wherein water particle size is unchangeable and oil-water separation does not occur, which is prepared by adding water (warm water) to heavy oil being a base fuel, by adding four kinds of inorganic component to maintain a stable emulsion state and by mixing them. If only one of the four elements of the inorganic component is lacking, the oil separates from the water irrespective of the mixing function when the emulsion is heated.

The sodium, magnesium, calcium and chlorine of the inorganic component are preferably supplied as water soluble inorganic compounds. Examples of water soluble inorganic compounds for each element are listed below. The example of the sources of supply of sodium is sodium hydroxide, sodium carbonate, sodium chloride, sodium sulfate, sodium nitrate, sodium phosphate, sodium borate and the like. Sodium hydroxide and sodium carbonate are preferable. The example of the sources of the supply of magnesium is magnesium chloride, magnesium sulfate, magnesium nitrate and the like. Magnesium chloride is preferable. The example of the sources of supply of calcium is calcium chloride, calcium sulfate, calcium nitrate and the like. Calcium chloride is preferable. The example of the sources of supply of chlorine is sodium chloride, calcium chloride, magnesium chloride, potassium chloride and the like. Calcium chloride and magnesium chloride are preferable.

The mixer for the industrial use is sufficient for the preparation of the present fuel and the preferable particle size of water in oil is 10 to 60 μm though it depends on the specification of the burner equipped on the combustor. General industrial water and drinking water (water from water supply) are preferable as the water to be mixed and it is preferable that the temperature of water is accordance with one of heavy oil. The mixing ratio of water to oil should be changed in obedience to calorific power to be needed, and corresponding to each amount of oil and water having different mixing ratio the amount of addition of four kinds of inorganic component should be naturally changed. For example, in the case that 1 weight part of water is used to 13 weight parts (10,000 liters) of heavy oil, about 944 g of inorganic components is added, and in the case that 1 weight part of water is used to 6 weight parts (10,000 liters) of heavy oil, about 1400 g of inorganic components is added, and in the case that 1 weight part of water is used to 4 weight parts (10,000 liters) of heavy oil, about 2530 g of inorganic components is added. As it is clear from above examples, the more inorganic components are added as the higher ratio of the amount of water to the amount of heavy oil is used so that the stabilization of emulsion state is designed. And the amount of inorganic components corresponding to the various combination of the amount of water and oil mixed is listed in Table 1, and the oil-water emulsion fuel attaining the purpose of the present invention can be obtained by mixing each component within the range of Table 1.

TABLE 1

| | amount of oil and water | | | | | |
|---|---|---|---|---|---|---|
| inorganic component | oil (L) 10000 | water (L) 500–1000 | oil (L) 10000 | water (L) 1500–2000 | oil (L) 10000 | water (L) 2500–3000 |
| Sodium (g) | 485–608 | | 675–948 | | 1222–1710 | |
| Magnesium (g) | 17–21 | | 23–34 | | 42–59 | |
| Calcium (g) | 23–29 | | 32–45 | | 59–82 | |
| Chlorine (g) | 313–392 | | 436–612 | | 790–1106 | |

It was confirmed that the water particles are covered with thin film and are capsulized by oil when the oil-water emulsion fuel of the present invention was observed by microscope photography at the time of one week after the production. This is the phenomenon that a film is formed on the surface of water particle and the water particle is capsulized by oil as a result of the reaction among the components contained in heavy oil such as carbon, sulfur, nitrogen and the like, water and four kinds of inorganic components. While the present fuel was boiled under atmospheric pressure, it kept a boiling point of ca. 105° C., and when heating was stopped and the temperature fell to the room temperature (25–30° C.), the oil-water separation was not occurred and any change in the capsule was not observed. Further, after the fuel of the room temperature was transferred into the room of −7° C. and was kept there for one week, it was transferred back to room temperature. After two days, the situation was the same as described above. After being kept in the room of 25° C. for 7 days, 100 ml of the fuel of the present invention was heated for 20 minutes in the hot water maintained at 80° C., and after the temperature of the fuel was confirmed to be in the same temperature as that of the hot water the fuel was allowed to oil-water separation test for 20 minutes adding the relative centrifugal force of 600 in a centrifugal separator adjusted at 80±2° C. Any oil-water separation was not observed.

Each three pieces of iron nail as the specimen was put in three separate vessels containing the fuel of the present invention, heavy oil and water each, and after every one week the degree of corrosion was estimated by visual observation. With nails in the vessel containing water, oxidization phenomenon became clear after 2 weeks and all of three nails were wholly oxidized when 5 weeks passed. With nails in the vessel containing heavy oil, oxidization phenomenon was not observed even after half an year. With nails in the vessel containing the present fuel, the situation was the same as nails in heavy oil. The results of the corrosion in water and in heavy oil was reasonable, but it is natural to be considered that in the fuel of the present invention nails would contact with the water particles in the fuel and would be partly oxidized. But as described above, the water particles in the fuel are capsulized by chemical reaction and in this situation the water particles do not come out to the surface. Thus water does not contact to not only vessel wall but also the surface of nails and therefore nails would be never oxidized to corrosion.

As described above, the oil-water emulsion fuel according to the present invention can retain the very strong emulsion state by addition of four kinds of the inorganic components and the cohesion among water particles does not occurred in any change of temperature and the water particles can retain a constant size. Therefore the fuel do not bring about oil-water separation and each particle of water is contained in oil without changing from a heating stage to burner spraying stage, and the ideal micro explosion occurs, surrounding oil drops are divided to super fine particles and the evaporation of oil is accelerated and mixing with air is accelerated so that the diffusion combustion is promoted. As the result, a good condition for combustion is prepared and a stable high temperature is maintained in the inside of the combustion chamber. As any of the equipments such as fuel pipes and burners does not come to contact with water, excellent protective effect from corrosion is attainable.

If the oil-water emulsion fuel according to the present invention differed from the components composing conventional heavy oil, or on the combustion new substances are produced or there is the possibility of the production of new substances, it is difficult in the aspect of the security and environment to use this fuel. But as shown in comparison of analysis data of the components in Table 2, any heterogeneous component does not contained and further on the combustion any worse element is not found, but inversely the better tendency is shown. It is safe to use.

TABLE 2

| components | fuel: heavy oil (C-type heavy oil) | fuel: oil-water emulsion fuel (C-type heavy oil 5 pts. : water 1 pt.) |
|---|---|---|
| water (Vol. %) | 0.00 | 15.6 |
| ash (wt. %) | 0.02 | 0.07 |
| sulfur (wt. %) | 3.22 | 2.27 |
| carbon (wt. %) | 80.92 | 57.22 |
| hydrogen (wt. %) | 9.14 | 9.19 |
| nitrogen (wt. %) | 0.22 | 0.19 |
| chlorine (ppm) | 4 | 97 |
| sodium (ppm) | 6 | 200 |
| calcium (ppm) | 1≧ | 1 |
| magnesium (ppm) | 1≧ | 1 |
| vanadium (ppm) | 66 | 45.76 |
| iron (ppm) | 9 | 7 |
| aluminum (ppm) | 1 | 1 |
| nickel (ppm) | 25 | 21 |
| silicon (ppm) | 3 | 5 |
| dynamic viscosity [at 50° C.] ($mm^2/S$) | 180 | 287 |
| total calorific power (J/g) | 42350 | 35900 |

The present invention is illustrated by following Examples.

EXAMPLE 1

Oil-water emulsion fuel according to the present invention obtained by supplying and mixing at the rate of 3000 to 6000, L/hr (because of the load fluctuation of the operating condition in the factory) of C-type heavy oil, 650 L/hr (constant) of water and 15 L/hr of aqueous solution which contains 3 kg of sodium carbonate, 10 kg of sodium hydroxide, 10.8 kg of calcium chloride and 2.5 kg of magnesium chloride in 100 L of water (from water supply) was burnt in 75 t/hr-natural circular type operating boiler. The results were as follows.

1) On the condition of 3% of oxygen concentration in exhaust gas where operating is being conducted by single burning of C-type heavy oil, only the fuel was converted to oil-water emulsion fuel of the present invention without changing other operating condition. Combustion condition, increase or decrease of nitrogen oxides, the concentration of smoke and evaporation ratio etc. were compared with those in the combustion at single burning of C-type heavy oil. With the combustion state the flame was very short and brightness was high. The transparency in the combustion chamber increased and very preferable combustion was obtained. The nitrogen oxides decreased by 15 ppm on average and the amplitude of smoke indicator reduced to about 1/10 irrespective of load fluctuation. The evaporation ratio decreased by 0.08 on average.

2) The condition of oxygen concentration in exhaust gas only was changed from 3% to 0.5% step by step under the condition of above 1) and the characteristics in combustion were compared with those in combustion at single burning of C-type heavy oil and in combustion under the condition of above 1). The combustion state became further better than at above 1) and the amount of nitrogen oxides decreased by maximum 35 ppm in comparison with combustion at single burning of C-type heavy oil and by maximum 20 ppm in comparison with the condition of above 1). The concentration of smoke increased at the range of 0.8–0.5% of the oxygen concentration in the exhaust gas but the coloring of the smoke was not observed at all. The evaporation ratio was the same as that at above 1).

EXAMPLE 2

Oil-water emulsion fuel according to the present invention obtained by supplying and mixing at the rate of 280 L/hr of C-type heavy oil, 56 L/hr of water and 0.8 L/hr of aqueous solution which contains 3 kg of sodium carbonate, 10 kg of sodium hydroxide, 10.8 kg of calcium chloride and 2.5 kg of magnesium chloride in 100 L of water (from water supply) was burnt in heat medium boiler (in operation). The results were as follows. In this Example, the condition was chosen not to bring about the aggravation of combustion and the increase of concentration of smoke for the purpose of the decrease of nitrogen oxides.

1) In the comparison of the combustion state using the present oil-water emulsion fuel under the condition of 5.5% of oxygen concentration in exhaust gas with single burning of C-type heavy oil (usual operation) under the condition of 5.5% of oxygen concentration in exhaust gas, the combustion state was better in the former and there was no difference in the concentration of smoke. The amount of nitrogen oxides decreased by 25 ppm in the former.

2) In the comparison of the combustion state using the present oil-water emulsion fuel under the condition of 3% of the oxygen concentration in exhaust gas with single burning of C-type heavy oil under the condition of 5.5% of the oxygen concentration in exhaust gas, the combustion state was better and the concentration of smoke was decreased in the former. The amount of nitrogen oxides decreased by 45 ppm in the former.

EXAMPLE 3

Oil-water emulsion fuel according to the present invention obtained by supplying and mixing at the rate of 4000 to 6500 L/hr (because of the load fluctuation of operating condition in the factory) of C-type heavy oil, constant amount of water of 12% based on the flow rate of C-type heavy oil and 11–18 L/hr of aqueous solution which is 3 kg of sodium carbonate, 10 kg of sodium hydroxide, 10.8 kg of calcium chloride and 2.5 kg of magnesium chloride in 100 L of water (from water supply) was burnt using two of 55 t/hr-natural circular type operating boiler (the fuel was supplied to two boilers through a branch from one pump line). Combustion state, increase or decrease of nitrogen oxides, the concentration of smoke and the situation of smoke scattering, fuel consumption due to evaporation ratio etc. were compared with those in the combustion at single burning of C-type heavy oil (usual operation). The load fluctuation of each boiler was not constant from time to time, but as mixing ratio of oil and water was constant at any time there was no fluctuation in quality of fuel. Combustion state was good, the inside of combustion chamber was transparent, and flame was very short. The amount of nitrogen oxides decreased by 18 ppm at 3.8% of the oxygen concentration in exhaust gas. The concentration of smoke is the same and the scattering of smoke disappeared in three days after converted to the fuel of the present invention. The evaporation ratio decreased a little, but the fuel consumption was saved by 6% more than in single burning of heavy oil on the base of substantial C-type heavy oil without water. When the water pipe and gas pipe of the combustion chamber were cleaned at one week after operation was stopped for routine inspection, it was clarified that the adhesion of scales was little and they were easy to be stripped, and therefore the efficiency of operation was good, too. It was also confirmed that the adhesion was a little in smoke passage, too and the effect to prevent the corrosion of equipment was hopeful.

INDUSTRIAL APPLICABILITY

As described above, differing from conventional oil-water emulsion fuel, a oil-water emulsion fuel according to the present invention does not bring about the separation between oil and water on any temperature change. Therefore, the fuel can retain particle size of water particle constant even at heating process, and ideal micro-explosion is possible in the combustion chamber and the good combustion state is always obtainable. The combustion at low air ratio is possible and the production of nitrogen oxides and the like decreases. Further, the heat conductivity to water pipe is improved due to a little adhesion of scale and it works efficiently for decrease of smoke and prevention of oxidation and the like. Thus this fuel bears a great fruit on the user and has very high practical effect and its value as an article is very high, too.

What is claimed is:

1. A water-in-oil, oil-water emulsion fuel which is obtained by mixing heavy oil and water together with an inorganic component, wherein said inorganic component comprises sodium, magnesium, calcium and chlorine, wherein once the emulsion is obtained, oil-water separation does not occur and the emulsion state is maintained even if any temperature is added during combustion, and a stable state of the combustion is always attained.

2. The oil-water emulsion fuel according to claim 1, wherein the amount of the inorganic component is adjusted with respect to the total amounts of water and heavy oil.

3. The oil-water emulsion fuel according to claim 1, wherein the inorganic component comprises 485–608 g of sodium, 17–21 g of magnesium, 23–29 g of calcium and 313–392 g of chlorine when 500–1000 liters of water are mixed with 10000 liters of heavy oil.

4. The oil-water emulsion fuel according to claim 1, wherein the inorganic component comprises 675–948 g of sodium, 23–34 g of magnesium, 32–45 g of calcium and 436–612 g of chlorine when 1500–2000 liters of water are mixed with 10000 liters of heavy oil.

5. The oil-water emulsion fuel according to claim 1, wherein the inorganic component comprises 1222–1710 g of sodium, 42–59 g of magnesium, 59–82 g of calcium and 790–1106 g of chlorine when 2500–3000 liters of water are mixed with 10000 liters of heavy oil.

6. The emulsion fuel according to claim 1, wherein the inorganic component is provided in an aqueous solution.

7. The emulsion fuel according to claim 1, wherein the inorganic component comprises a water-soluble inorganic compound.

* * * * *